US008715106B1

(12) United States Patent
Seluga et al.

(10) Patent No.: US 8,715,106 B1
(45) Date of Patent: May 6, 2014

(54) ADJUSTABLE IRON-TYPE GOLF CLUB HEAD

(71) Applicant: Callaway Golf Company, Carlsbad, CA (US)

(72) Inventors: James A. Seluga, Carlsbad, CA (US); Sean Griffin, Carlsbad, CA (US); Evan D. Gibbs, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 13/737,555

(22) Filed: Jan. 9, 2013

Related U.S. Application Data

(60) Provisional application No. 61/591,773, filed on Jan. 27, 2012, provisional application No. 61/716,689, filed on Oct. 22, 2012.

(51) Int. Cl.
*A63B 53/06* (2006.01)

(52) U.S. Cl.
USPC ..... 473/335; 473/334; 473/349; 473/350; 473/348

(58) Field of Classification Search
USPC ..... 473/336, 335, 334, 330, 331, 349, 350, 473/348
See application file for complete search history.

(56) References Cited

U.S. PATENT DOCUMENTS

| | | | | |
|---|---|---|---|---|
| 6,811,496 | B2 * | 11/2004 | Wahl et al. | 473/334 |
| 7,338,387 | B2 * | 3/2008 | Nycum et al. | 473/332 |
| 7,559,850 | B2 * | 7/2009 | Gilbert et al. | 473/290 |
| 2002/0165041 | A1 * | 11/2002 | Takeda | 473/334 |
| 2003/0203764 | A1 * | 10/2003 | Dabbs et al. | 473/291 |
| 2011/0250985 | A1 * | 10/2011 | Stites | 473/332 |

* cited by examiner

*Primary Examiner* — Benjamin Layno
(74) *Attorney, Agent, or Firm* — Rebecca Hanovice; Michael A. Catania; Sonia Lari

(57) ABSTRACT

The present invention discloses an iron-type golf club head having features that permit adjustment to the principal moment of inertia angle, the center of gravity location, and overall club forgiveness. In particular, the golf club head includes a rear cavity sized to receive a weight cartridge composed of one or more materials, the adjustment of which changes one or more of the mass properties of the golf club head and may change the interaction of the golf club head with turf during play, and a composite face plate. The weight cartridge may comprise one or more high density materials, and may be located in or proximate the sole.

17 Claims, 2 Drawing Sheets

ADJUSTABLE IRON-TYPE GOLF CLUB HEAD

CROSS REFERENCES TO RELATED APPLICATIONS

The present application claims priority to U.S. Provisional Patent Application No. 61/591,773, filed on Jan. 27, 2012, the disclosure of which is hereby incorporated by reference in its entirety herein, and to U.S. Provisional Patent Application No. 61/716,689, filed on Oct. 22, 2012, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to an adjustable iron-type golf club head. More specifically, the present invention relates to an iron-type golf club with features that allow for the adjustment of the principal moment of inertia angle, including an adjustable weight cartridge and a lightweight face.

2. Description of the Related Art

The prior art discloses various types of golf club heads having preferred moments of inertia characteristics. In particular, U.S. Pat. No. 6,045,455, entitled "Inertially tailored golf dub heads," the disclosure of which is hereby incorporated in its entirety herein, and U.S. Pat. No. 6,186,905, entitled "Methods for designing golf club heads," the disclosure of which is hereby incorporated in its entirety herein, are both related to methods for designing inertially tailored golf club heads. The prior art does not, however disclose optimized, adjustable irons that permit a user to tailor the moment of inertia or center of gravity characteristics of his or her club.

Furthermore, traditional iron-type golf clubs include faces made of metal materials, and usually the same material as the rest of the iron body. This reduces the amount of discretionary weight available to manufacturers, which they otherwise would be able to use to adjust characteristics of the golf club head like moment of inertia and center of gravity location.

BRIEF SUMMARY OF THE INVENTION

The present invention provides an iron-type golf club with features that allow for the adjustment of mass properties such as one or more moment of inertia angles, the location of the center of gravity, and the weight of the golf club head.

One aspect of the present invention is an iron-type golf club head comprising a weight cartridge that adjusts the mass properties of the iron. In particular, changing the orientation of the weight cartridge with respect to the head changes one or more of the mass properties of the head. The weight cartridge may also affect the overall weight of the head. In some embodiments, the cartridge includes one or more sole surface features that affect the interaction of the head with the turf during play. In each of the embodiments disclosed, the weight cartridge is detachable and can be semi-permanently affixed to the golf club head.

Another aspect of the present invention is an iron-type golf club head comprising a body having a top portion, a sole portion, a heel, a toe, a face, and a rear cavity located proximate the sole portion, and a weight cartridge composed of at least one high density material and at least one low density material, wherein the weight cartridge has an asymmetric shape along at least one axis, wherein the weight cartridge is sized to fit within the rear cavity, and wherein changing the orientation of the weight cartridge within the rear cavity changes at least one principal moment of inertia angle or location of the golf club head center of gravity. The weight cartridge may have a middle portion and two end (portions, one or both of which may be disposed at an angle with respect to the middle portion.

In some embodiments, the middle portion may be composed of a low density material such as composite and one or both of the end portions may be composed of a high density material such as tungsten alloy. In other embodiments, the middle portion may be composed of a high density material such as tungsten alloy and one or both of the end portions may be composed of a low density material such as composite. In some embodiments, the weight cartridge may be removably secured within the rear cavity with a mechanical fastener or a semi-permanent adhesive material. In some embodiments, the weight cartridge affects interaction of the golf club head with turf during play, and replacing the weight cartridge with a second weight cartridge having a different shape or profile may change the interaction of the golf club head with the turf during play.

Yet another aspect of the present invention is a golf club head comprising a body comprising a top rail, a sole, a hosel, a heel, and a toe, a face plate composed of a lightweight material having a first density, and a weight insert, wherein the body is composed of a metal material having a second density that is greater than the first density. In some embodiments, the lightweight material may be a composite, the body may be composed of steel, and the weight insert may be composed of a tungsten alloy. In other embodiments, golf club head may comprise a recess sized to receive the weight insert, which may be permanently or removably fixed within the recess, and the recess may be located proximate or in the sole. In some embodiments, the golf club head may be an iron-type golf club head, such as a wedge. In some further embodiments, the heel may be squared and the toe may be flat, such that the golf club head has a low center of gravity. In other embodiments, the face plate may comprise grooves, which may be co-molded in the face plate from a metal material, such as titanium, if the face plate is composed of a plastic or composite material.

Another aspect of the present invention is an iron-type golf club head comprising a metal body comprising a sole, a top rail, a heel, a toe, and a hosel, a composite face plate comprising a plurality of grooves, and a tungsten weight insert, wherein the sole comprises a recess sized to receive the weight insert, and wherein the weight insert is welded within the recess. In some embodiments, the toe and heel may be squared. In other embodiments, the plurality of grooves may be co-molded with the face plate from a titanium alloy. In other embodiments, the body may be composed of a steel material, and the body may also have a low center of gravity.

Yet another aspect of the present invention is an iron-type golf club head comprising a steel body comprising a sole, a top rail, a heel, a toe, and a hosel, a composite face plate comprising a plurality of grooves, and a high-density weight insert, wherein the sole comprises a recess sized to releasably receive the weight insert, and wherein the plurality of grooves is co-molded with the face plate from a titanium alloy. The weight insert may be composed of a tungsten alloy, and may be secured within the recess with a screw. In alternative embodiments, the weight insert may be composed of multiple materials, such that changing the orientation of the weight insert within the recess alters one or more mass properties of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
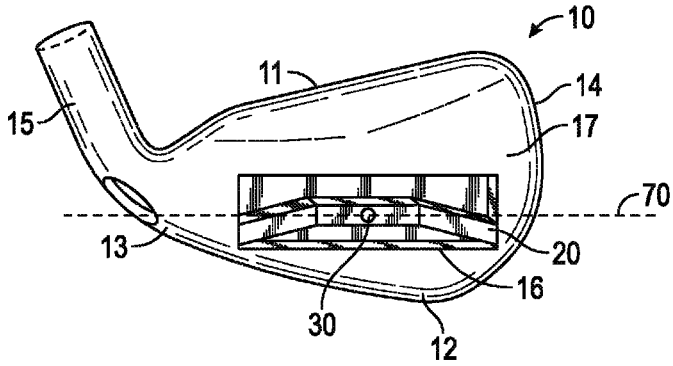
FIG. 1 is a rear perspective view of a first embodiment of the present invention.

A preferred embodiment of the iron-type golf club head 10 of the present invention is shown in FIG. 1. The golf club head 10 has a top portion 11 (also called a top rail), a sole portion 12, a heel portion 13, a toe portion 14, a hosel 15, a face (not shown), and a cavity 16 on the rear side 17 proximate the sole portion 12. A weight cartridge 20 is disposed within the cavity 16 and affixed to the golf club head 10 with a mechanical fastener 30 such as a screw, though in alternative embodiments the weight cartridge 20 may be semi-permanently disposed within the cavity 16 by any means known to a person of ordinary skill in the art, such as via clips or semi-permanent adhesive. The weight cartridge 20 can be composed of any number of materials, and preferably is asymmetric along at least one axis 70. In the preferred embodiment, when the weight cartridge 20 is disposed within the cavity 16, both the principal moment of inertia (MOI) angle and the center of gravity (CG) location of the golf club head 10 differ from the principle MOI angle and CG of the golf club head 10 when the weight cartridge 20 is not disposed within the cavity 16.

Figure 2:
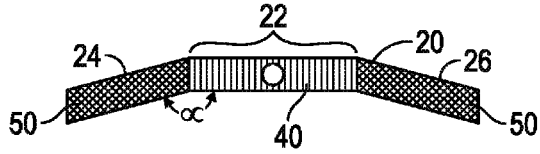
FIG. 2 is a plan view of a first weight cartridge.
Figure 3:
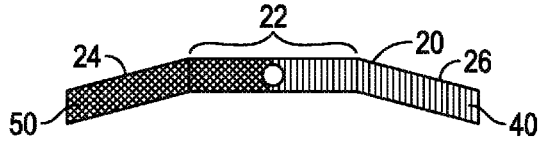
FIG. 3 is a plan view of a second weight cartridge.
Figure 4:
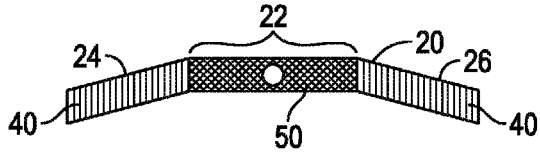
FIG. 4 is a plan view of a third weight cartridge.

As shown in FIGS. 2-4, the weight cartridge 20 may be made of multiple materials, or it may be made of a single material. In the preferred embodiment, shown in FIG. 2, the weight cartridge 20 has a middle portion 22 composed of one or more low density materials 40, such as plastic or composite, and two end portions 24, 26 disposed at an angle $\alpha$ with respect to the middle portion 22 and composed of one or more high density materials 50, such as a tungsten alloy. In an alternative embodiment, shown in FIG. 3, the weight cartridge 20 is evenly divided between low and high density materials 40, 50. In yet another embodiment, the middle portion 22 of the weight cartridge 20 is composed of one or more high density materials 50 and the end portions 24, 26 are composed of one or more low density materials 40. In the preferred embodiment, the middle portion 22 is composed of plastic and the end portions 24, 26 are composed of a tungsten alloy, but in alternative embodiments the end portions 24, 26 may be composed of two different high density materials.

The magnitude of the angle $\alpha$ affects the change in MOI and CG in the golf club head 10 when the weight cartridge 20 is adjusted or replaced with a weight cartridge 20 having a different material configuration. In order to adjust MOI angle and CG location in the preferred embodiment of the present invention, the mechanical fastener 30 is loosened and the weight cartridge 20 is flipped so that the end portions 24, 26 point upwards toward the top portion 11 instead of downwards towards the sole portion 12. Alternatively, the weight cartridge 20 may be removed and replaced with a weight cartridge 20 having a different material composition or a different angle $\alpha$ between the end portions 24, 26 and the middle portion 22. In another embodiment, the weight cartridge 20 may be adjusted so that the end portions 24, 26 point towards the heel portion 13 or toe portion 14 of the golf club head 10.

Through the use of one or more of the weight cartridges 20 disclosed herein, the adjustment of the moment of inertia angle leads to a greater increase in the forgiveness of the iron-type golf club head 10 than a change to the draw/fade bias of the iron, without requiring a change to the overall structure of the golf club head 10. The location of the weight cartridge 20 near the sole 12 of the golf club head 10 also is preferably designed to affect the interaction of the golf club head 10 with turf during play. The cavity 16 preferably extends into the sole 12, and the weight cartridge 20 preferably is shaped so that it interacts with the sole 12 of the golf club head 10, such that turf interaction is altered by changing the orientation of the weight cartridge 20 or replacing it with a different weight cartridge 20 having a different shape or turf interaction profile.

Figure 5:
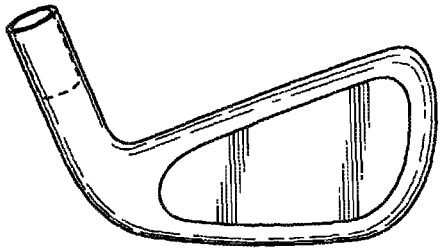
FIG. 5 (Prior Art)
FIG. 5 is a rear, plan view of a prior art, iron-type golf club head

Traditional golf clubs, and particularly iron-type golf clubs such as the prior art club shown in FIG. 5, have faces that are formed from one or more metal materials. In particular, iron-type golf club heads are made from various types of steel. This material is heavy and dense and causes the center of gravity (CG) of the club to be relatively high, thus making it more difficult for golfers to hit a golf ball into the air. In another embodiment of the present invention, the golf club head 10 comprises features that contribute to a lower center of gravity, which improves a golfer's ability to connect with a golf ball and get it airborne, and which, when combined with the weight cartridge 20 shown in FIGS. 1-4, allow for more significant adjustment of the golf club's mass properties.

Figure 6:
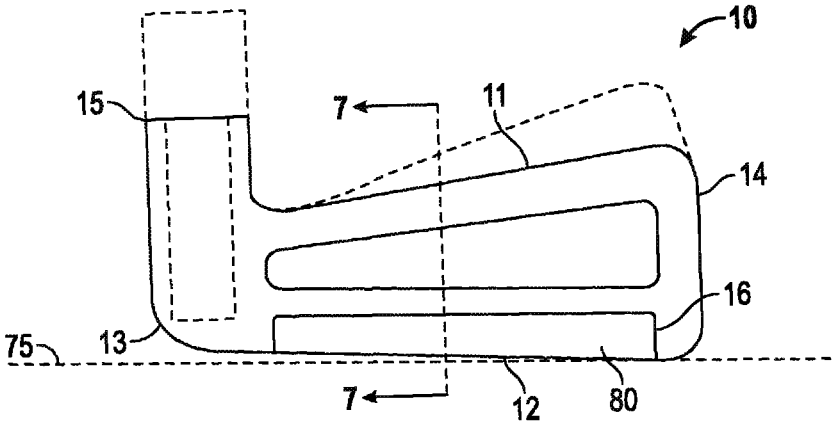
FIG. 6 is a rear, plan view of a second embodiment of the present invention.
Figure 7:
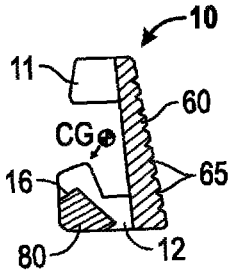
FIG. 7 is a cross-sectional view of the embodiment shown in FIG. 6 along lines 7-7.

In particular, FIGS. 6-7 show a second embodiment of the present invention. Like the preferred embodiment shown in FIG. 1, the golf club head 10 comprises a top portion 11, a sole portion 12, a heel portion 13, a toe portion 14, and a hosel 15. In contrast with the prior art golf club shown in FIG. 5, and the first embodiment shown in FIG. 1, the golf club head 10 shown in FIGS. 6 and 7 has a square heel portion 13 that makes greater contact with a ground plane 75, thus allowing the hosel 15 to be located lower to the ground. The golf club head 10 shown in FIGS. 6-7 also includes a flatter, squarer toe portion 14 that is closer to the ground than the toe portion 14 of prior art clubs. These inventive features move more material towards the ground plane 75, thus lowering the CG of the golf club head 10.

The golf club head 10 shown in FIGS. 6-7 also comprises a low-weight face plate 60, which is preferably formed from a high-strength composite material but may, in alternative embodiments, be made of plastic or low-density metal alloys. Grooves 65 are preferably co-molded into the face plate 60 from a high-strength metal alloy such as titanium. The golf club head 10 also includes a cavity 16 proximate the sole 12 that may be sized to receive the weight cartridge 20 shown in FIGS. 2-4, or can be sized to receive a high-density insert 80, which preferably is composed of a tungsten material but may, in alternative embodiments, be composed of other high-density or high-weight materials. The high-density insert 80 may be removable or may be permanently affixed to the cavity 16 by welding, adhesive, or some other mechanism such as a bolt or screw. The combination of the weight cartridge 20 or high-density insert 80 and the low-weight face plate 60 shifts the center of gravity towards the ground, thus increasing a golfer's ability to get a golf ball airborne.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as my invention the following:

1. An iron-type golf club head comprising:

a body having a top portion, a sole portion, a heel, a toe, a face, and a rear cavity located proximate the sole portion; and a weight cartridge, having an asymmetric shape along at least one axis, wherein the weight cartridge has a middle portion composed of a first material, and two end portions, at least one of which is composed of a second material having a density that differs from the first material, wherein at least one of the two end portions is disposed at an angle with respect to the middle portion, wherein the weight cartridge is sized to fit within the rear cavity, and wherein changing the orientation of the weight cartridge within the rear cavity changes at least one principal moment of inertia angle.

2. The iron-type golf club head of claim 1, wherein the first material is composed of a low density material, and wherein the second material is composed of a high density material.

3. The iron-type golf club head of claim 2, wherein the high density material is a tungsten alloy, and wherein the low density material is a composite material.

4. The iron-type golf club head of claim 1, wherein the first material is composed of a high density material, and wherein the second material is composed of a low density material.

5. The iron-type golf club head of claim 4, wherein the high density material is a tungsten alloy, and wherein the low density material is a composite material.

6. The iron-type golf club head of claim 1, wherein the weight cartridge is removably secured within the rear cavity with a mechanical fastener.

7. The iron-type golf club head of claim 1, wherein the weight cartridge affects interaction of the golf club head with turf during play.

8. The iron-type golf club head of claim 7, wherein replacing the weight cartridge with a second weight cartridge having a different profile changes the interaction of the golf club head with the turf during play.

9. An iron-type golf club head comprising:

a body comprising a top rail, a sole, a hosel, a heel, and a toe;

a face plate composed of a first material selected from the group consisting of composite and plastic; and a weight cartridge comprising a middle portion and two end portions, wherein the body is composed of a second material having a density that is greater than the density of the first material, wherein the middle portion is composed of a third material, wherein at least one of the two end portions is composed of a fourth material having a density that differs from the third material, and wherein at least one of the two end portions is disposed at an angle with respect to the middle portion.

10. The iron-type golf club head of claim 9, wherein the third material is a tungsten alloy.

11. The iron-type golf club head of claim 9, wherein the sole comprises a recess sized to receive the weight cartridge.

12. The iron-type golf club head of claim 11, wherein changing the orientation of the weight cartridge within the recess changes at least one mass property selected from the group consisting of a principal moment of inertia angle and a center of gravity.

13. The iron-type golf club head of claim 9, wherein the heel is squared and the toe is flat.

14. The iron-type golf club head of claim 9 wherein the face plate comprises grooves, and wherein the grooves are co-molded in the face plate from a metal material.

15. The iron-type golf club head of claim 14, wherein the grooves are composed of a titanium material.

16. The iron-type golf club head of claim 9, wherein the body is composed of steel.

17. The iron-type golf club head of claim 9, wherein the weight cartridge is secured within the recess with a screw.

* * * * *